US012528659B2

(12) United States Patent
Tamura

(10) Patent No.: US 12,528,659 B2
(45) Date of Patent: Jan. 20, 2026

(54) CONVEYING APPARATUS, CONTROLLER, CONTROL METHOD, AND MEDIUM STORING PROGRAM FOR CONVEYING APPARATUS

(71) Applicant: BROTHER KOGYO KABUSHIKI KAISHA, Nagoya (JP)

(72) Inventor: Hikaru Tamura, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/817,561

(22) Filed: Aug. 28, 2024

(65) Prior Publication Data

US 2025/0074735 A1 Mar. 6, 2025

(51) Int. Cl.
*B65H 20/02* (2006.01)

(52) U.S. Cl.
CPC ..... *B65H 20/02* (2013.01); *B65H 2404/142* (2013.01); *B65H 2404/1422* (2013.01); *B65H 2404/144* (2013.01); *B65H 2405/31* (2013.01); *B65H 2405/42* (2013.01)

(58) Field of Classification Search
CPC ..... B65H 2404/144; B65H 1404/1441; B65H 2404/1442; B65H 20/02; B65H 2405/42; B65H 1/266
See application file for complete search history.

(56) References Cited

U.S. PATENT DOCUMENTS 8,925,432 B2 * 1/2015 Eoka ..... B65H 20/02 83/13
2022/0212888 A1 * 7/2022 Tatematsu ..... B65H 19/12

FOREIGN PATENT DOCUMENTS

JP H06-278938 A 10/1994
JP H08-169580 A 7/1996
JP H09-1883 A 1/1997

* cited by examiner

*Primary Examiner* — Jeremy R Severson
(74) *Attorney, Agent, or Firm* — Element IP, PLC

(57) ABSTRACT

A conveying apparatus includes a conveyor which conveys a first sheet medium unwound from a roll body in a conveyance direction and which has first and second rollers to nip the first sheet medium at a nipping point; a pressing mechanism which is moved to a pressing position at which the first and second rollers are pressed against each other and a release position at which the first and second rollers are released from being pressed against each other; a detector which detects the first sheet medium located downstream of the nipping point; and a controller. The controller executes a first determining process of determining whether the first sheet medium is detected by the detector; a pressing process of moving the pressing mechanism from the release position to the pressing position; and a conveying process of causing the conveyor to convey the first sheet medium after the pressing process.

8 Claims, 6 Drawing Sheets

CONVEYING APPARATUS, CONTROLLER, CONTROL METHOD, AND MEDIUM STORING PROGRAM FOR CONVEYING APPARATUS

REFERENCE TO RELATED APPLICATIONS

This application claims the priority from Japanese Patent Application No. 2023-141365 filed on Aug. 31, 2023. The entire contents of the priority-claimed application are incorporated herein by reference.

BACKGROUND ART

Conventionally, an ink-jet recording mechanism is known. The ink-jet recording mechanism includes an accommodating part which accommodates a rolled sheet, a conveyance passage for conveying the rolled sheet from the accommodating part to an ink-jet head, and conveying rollers which nip and convey the rolled sheet on the conveyance passage, after the rolled sheet has been accommodated in the accommodating part. In this ink-jet recording mechanism, one of the conveying rollers is attached to a cover, and the other of the conveying rollers is attached to a main apparatus body.

In a case where the rolled sheet is to be exchanged and where the cover is opened, one of the conveying rollers is separated from the other, and the conveyance passage is released. After that, in a case where the rolled sheet is accommodated in the accommodating part and the cover is closed, one of the conveying rollers is moved toward the main body, and one of the conveying rollers nips the rolled sheet together with the other of the conveying rollers. After that, the rolled sheet is conveyed by the conveying rollers.

SUMMARY

In a case where the cover is closed in the ink-jet recording mechanism (conveying apparatus) described above, such a situation might arise wherein the rolled sheet (a sheet medium unwound from a roll body) is not arranged such that the rolled sheet is nipped by the conveying rollers (roller pair). In such a situation, the roller pair is rotated although the sheet medium is not nipped by the roller pair, and hence an unloaded feed wherein the sheet medium is not fed arises.

An object of the present disclosure is to provide a conveying apparatus, a controller, a control method, and a medium storing a program for the conveying apparatus each of which enables to appropriately convey a sheet medium unwound from a roll body.

A conveying apparatus according to the present disclosure includes: a conveyor configured to convey a first sheet medium unwound from a roll body in a conveyance direction, the conveyor having a first roller and a second roller configured to nip the first sheet medium at a nipping point; a pressing mechanism configured to be moved to a pressing position at which the first roller and the second roller are pressed against each other and a release position at which the first roller and the second roller are released from being pressed against each other; a detector configured to detect the first sheet medium located downstream of the nipping point in the conveyance direction; and a controller. The controller is configured to execute: a first determining process of determining whether the first sheet medium is detected by the detector; a pressing process of moving the pressing mechanism from the release position to the pressing position in a case where the controller determines that the first sheet medium is detected in the first determining process; and a conveying process of causing the conveyor to convey the first sheet medium by rotating the first roller and the second roller after the pressing process.

A control method according to the present disclosure controls a conveying apparatus. The conveying apparatus includes: a conveyor configured to convey a sheet medium unwound from a roll body in a conveyance direction, the conveyor having a first roller and a second roller configured to nip the sheet medium at a nipping point; a pressing mechanism configured to be moved to a pressing position at which the first roller and the second roller are pressed against each other and a release position at which the first roller and the second roller are released from being pressed against each other; and a detector configured to detect the sheet medium located downstream of the nipping point in the conveyance direction. The control method includes a first determining process of determining whether the sheet medium is detected by the detector; a pressing process of moving the pressing mechanism from the release position to the pressing position in a case where a determination is made that the sheet medium is detected in the first determining process; and a conveying process of causing the conveyor to convey the sheet medium by rotating the first roller and the second roller after the pressing process.

A non-transitory medium according to the present disclosure stores program for a conveying apparatus. The conveying apparatus includes: a conveyor configured to convey a sheet medium unwound from a roll body in a conveyance direction, the conveyor having a first roller and a second roller configured to nip the sheet medium at a nipping point; a pressing mechanism configured to be moved to a pressing position at which the first roller and the second roller are pressed against each other and a release position at which the first roller and the second roller are released from being pressed against each other; and a detector configured to detect the sheet medium located downstream of the nipping point in the conveyance direction. The program causes the conveying apparatus to execute: a first determining process of determining whether the sheet medium is detected by the detector; a pressing process of moving the pressing mechanism from the release position to the pressing position in a case where a determination is made that the sheet medium is detected in the first determining process; and a conveying process of causing the conveyor to convey the sheet medium by rotating the first roller and the second roller after the pressing process.

According to the present disclosure, the first roller and the second roller are rotated to start the conveyance of the sheet medium in a state that the sheet medium is reliably nipped by the first roller and the second roller. Accordingly, the sheet medium, which is unwound from the roll body, can be appropriately conveyed.

DESCRIPTION

Overall Configuration of Printer

Figure 1:
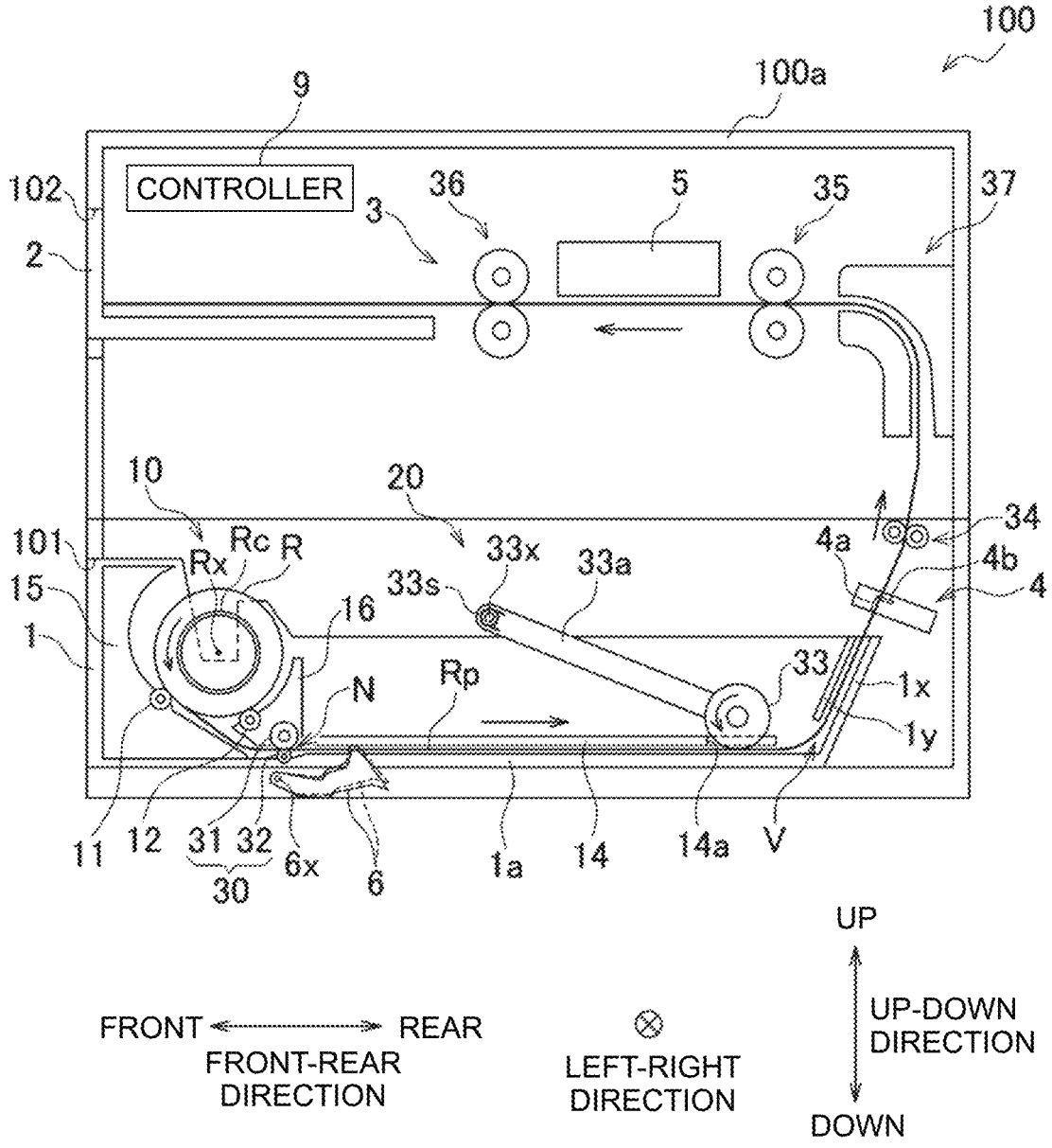
FIG. 1 is a side view depicting a state where a roll body is accommodated in a sheet feed tray in a printer according to an embodiment of the present disclosure.
Figure 2:
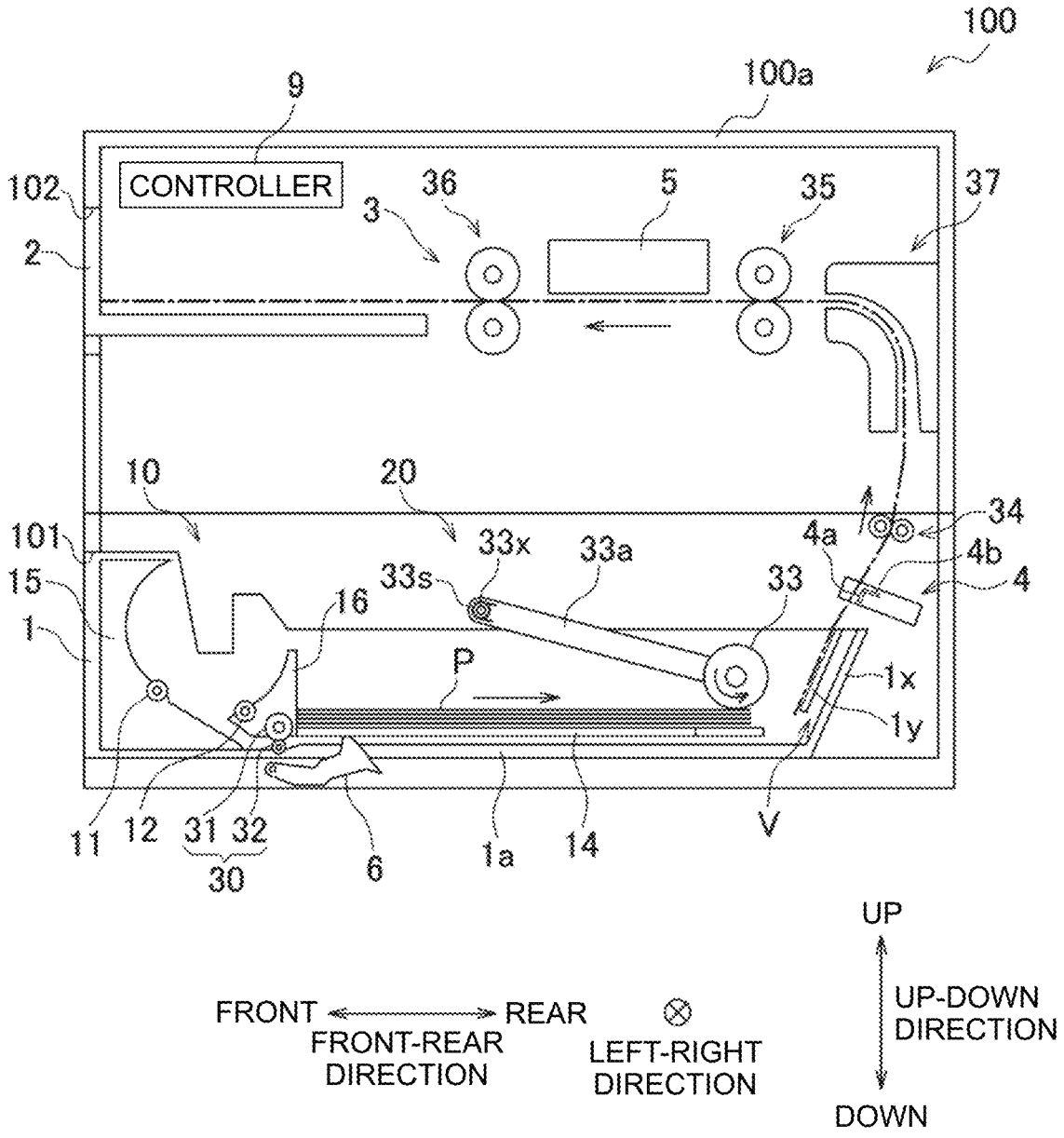
FIG. 2 is a side view depicting a state where cut sheets are accommodated in the sheet feed tray in the printer depicted in FIG. 1.

A printer 100 depicted in FIG. 1 and FIG. 2 is an embodiment of the "conveying apparatus" according to the present disclosure. The printer 100 includes a casing 100*a*, a sheet feed tray 1, a sheet discharge tray 2, a conveyor 3, a cutting part 4, a head 5, and a controller 9. Components which construct the conveyor 3 and which are other than rollers 11, 12 and a roller pair 30 (to be described later on), the cutting part 4, the head 5, and the controller 9 are supported by the casing 100*a*.

The sheet feed tray 1 is an embodiment of the "tray" of the present disclosure. The sheet feed tray 1 is movable in the front-rear direction with respect to the casing 100*a*. The sheet feed tray 1 is configured to be moved in the front-rear direction to the attached position at which the sheet feed tray 1 is attached to the casing 100*a* (see FIG. 1, FIG. 2, and FIG. 4B) and to the withdrawn position at which the sheet feed tray 1 is withdrawn from the attached position (see FIG. 4A). The withdrawn position is located in front of the attached position. The sheet feed tray 1 can be inserted/withdrawn with respect to the casing 100*a* via an opening 101 defined in a front wall of the casing 100*a*.

The sheet feed tray 1 has a first accommodating part 10 capable of accommodating a roll body R (see FIG. 1) and a second accommodating part 20 capable of accommodating a plurality of cut sheets P in a stacked state (see FIG. 2). The first accommodating part 10 and the second accommodating part 20 are aligned in the front-rear direction. The first accommodating part 10 is positioned in front of the second accommodating part 20.

As depicted in FIG. 1, the roll body R has a cylindrical core member Rc and a lengthy rolled sheet Rp wound around an outer circumferential surface of the cylindrical core member Rc. The roll body R is accommodated in the first accommodating part 10 in a state where an axis Rx of the core member Rc extends in the left-right direction.

The cut sheet P is a sheet having, for example, A4 size or letter size. The cut sheet P is accommodated in the second accommodating part 20 in a state where the longitudinal direction thereof extends in the left-right direction. The length of the cut sheet P in the longitudinal direction is shorter than the length of the rolled sheet Rp in the winding direction.

The rolled sheet Rp corresponds to the "first sheet medium" and the "sheet medium" of the present disclosure. The cut sheet P (the plurality of cut sheets P) corresponds to the "second sheet medium" (the "plurality of second sheet media") of the present disclosure.

The sheet feed tray 1 has holders 15, 16, the rollers 11, 12, the roller pair 30, and a support plate 14. The rollers 11, 12 and the roller pair 30 construct the conveyor 3. As depicted in FIG. 1, the holders 15, 16 hold the roll body R accommodated in the first accommodating part 10. As depicted in FIG. 2, the support plate 14 supports the cut sheet(s) P accommodated in the second accommodating part 20.

The holder 15 is positioned in front of the holder 16. The roller 11 is disposed in the inner surface of the holder 15, and the roller 12 is disposed in the inner surface of the holder 16. The rollers 11, 12 rotate about shafts extending in the left-right direction. In a case where the roll body R is accommodated in the first accommodating part 10, the roll body R is supported by the rollers 11, 12 at the outer circumferential surface of a lower part of the roll body R.

A passage is defined between a lower surface of the holder 16 and an upper surface of a bottom wall 1*a* of the sheet feed tray 1. The rolled sheet Rp unwound from the roll body R accommodated in the first accommodating part 10 passes the passage. The roller pair 30 is disposed at a lower end part of the holder 16, and the roller pair 30 nips the rolled sheet Rp at a nipping point N located in the passage. The roller pair 30 includes an upper roller 31 and a lower roller 32 which are aligned in the up-down direction with the nipping point N being interposed between the upper roller 31 and the lower roller 32. The upper roller 31 and the lower roller 32 rotate about shafts extending in the left-right direction. The upper roller 31 and the lower roller 32 correspond to the "first roller and second roller" of the present disclosure.

The support plate 14 is positioned above the bottom wall 1*a* and behind the holder 16. The passage, through which the rolled sheet Rp unwound from the roll body R accommodated in the first accommodating part 10 passes, is defined between a lower surface of the support plate 14 and the upper surface of the bottom wall 1*a*. The support plate 14 has a cutout 14*a* at a central part in the left-right direction of a rear end of the support plate 14.

The sheet discharge tray 2 is disposed above the sheet feed tray 1. The sheet discharge tray 2 can be inserted/withdrawn with respect to the casing 100*a* via an opening 102 defined in the front wall of the casing 100*a*.

The conveyor 3 is configured to convey the rolled sheet Rp unwound from the roll body R accommodated in the first accommodating part 10 or to convey an uppermost cut sheet P of the plurality of cut sheets P which are accommodated in the second accommodating part 20, in a conveyance direction (direction indicated by arrows in FIG. 1 and FIG. 2) from the sheet feed tray 1 to the sheet discharge tray 2. The conveyor 3 has the rollers 11, 12 and the roller pair 30 described above, a sheet feed roller 33, roller pairs 34 to 36, and a guide 37.

The sheet feed roller 33 corresponds to the "sheet feed roller" of the present disclosure. The sheet feed roller 33 is supported rotatably at a forward end of an arm 33*a*. The arm 33*a* has a forward end which supports the sheet feed roller 33 and a proximal end at which a shaft 33*x* is disposed. The shaft 33*x* is supported by the casing 100*a*.

The arm 33*a* is swingable with respect to the casing 100*a* about the shaft 33*x*. The sheet feed roller 33 is moved to a first position (see FIG. 1) and to a second position (see FIG. 2) in accordance with a swing of the arm 33*a* about the shaft 33*x*. At the first position, the sheet feed roller 33 can feed the rolled sheet Rp unwound from the roll body R accommodated in the first accommodating part 10. At the second position, the sheet feed roller 33 can feed the uppermost cut sheet P of the plurality of cut sheets P accommodated in the second accommodating part 20. In a case where the sheet feed roller 33 is located at the first position (see FIG. 1), the sheet feed roller 33 is located in the cutout 14*a* of the support plate 14, and the sheet feed roller 33 contacts with the rolled sheet Rp located below the support plate 14, through the cutout 14*a*. In other words, the cutout 14*a* of the support plate 14 is positioned on the movement locus of the sheet feed roller 33.

The arm 33*a* is urged, by a torsion spring 33*s* wound around the shaft 33*x*, in a direction in which the sheet feed roller 33 approaches the bottom wall 1*a* of the sheet feed tray 1 (i.e., in the direction in which the sheet feed roller 33 contacts with the cut sheet P). The torsion spring 33*s* corresponds to the "urging part" of the present disclosure.

Each of the roller pairs 34 to 36 includes a driving roller and a driven roller which is rotated in accordance with a rotation of the driving roller.

Figure 5:
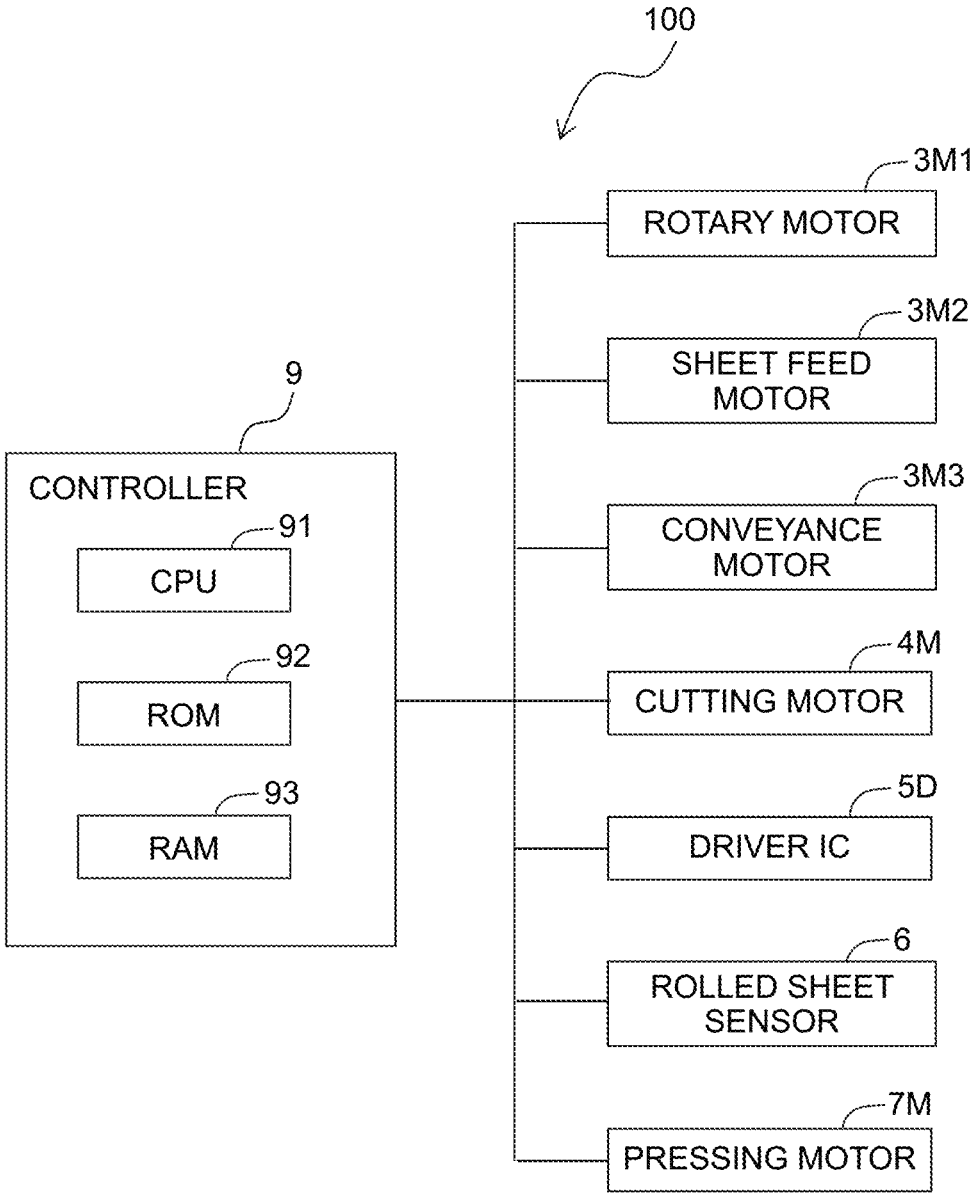
FIG. 5 is a block diagram depicting an electric configuration of the printer depicted in FIG. 1.

In the conveyor 3, the upper roller 31 of the roller pair 30 is rotated by driving of a rotary motor 3M1 (see FIG. 5). The sheet feed roller 33 is rotated by driving of a sheet feed motor 3M2 (see FIG. 5). The driving rollers of the roller pairs 34 to 36 are rotated by driving of a conveyance motor 3M3 (see FIG. 5). The rotary motor 3M1 corresponds to the "motor" of the present disclosure.

As depicted in FIG. 1, in a state where the roll body R is accommodated in the first accommodating part 10, the rolled sheet Rp, which is unwound from the roll body R, passes through a space between the lower surface of the holder 16 and the upper surface of the bottom wall 1*a*. The rolled sheet Rp further passes through a space between the lower surface of the support plate 14 and the upper surface of the bottom wall 1*a*, and the rolled sheet Rp is drawn toward the sheet feed roller 33. The rolled sheet Rp is sent out (fed) rearward in accordance with the rotation of the roller pair 30 by the driving of the rotary motor 3M1 and the rotation of the sheet feed roller 33 by the driving of the sheet feed motor 3M2. Accompanying this, the roll body R is rotated in the direction of the arrow, thereby rotating the rollers 11, 12.

As depicted in FIG. 2, in a state where the plurality of cut sheets P are accommodated in the second accommodating part 20 and in a case where the sheet feed roller 33 is rotated in accordance with the driving of the sheet feed motor 3M2, the uppermost cut sheet P (cut sheet P with which the sheet feed roller 33 contacts) among the plurality of cut sheets P is fed rearward.

A rear wall of the sheet feed tray 1 (a wall constructing a downstream end in the conveyance direction) has a first wall part 1*x* and a second wall part 1*y* which is separated frontward from the first wall part 1*x*. The space between the first wall part 1*x* and the second wall part 1*y* constructs a conveyance passage V along which the rolled sheet Rp travels from the roller pair 30 to the cutting part 4.

As depicted in FIG. 1, the rolled sheet Rp, which is fed by the roller pair 30 and the sheet feed roller 33, passes through the conveyance passage V and is conveyed toward the cutting part 4. Further, the rolled sheet Rp is conveyed toward the roller pair 34. On the other hand, as depicted in FIG. 2, the cut sheet P, which is fed by the sheet feed roller 33, does not pass through the conveyance passage V. The cut sheet P is conveyed along a route passing along a front surface of the second wall part 1*y*, and the cut sheet P is conveyed toward the roller pair 34. Note that the cut sheet P, of the plurality of cut sheets P, which is located in the vicinity of the upper surface of the support plate 14, may be conveyed along the route which does not pass through the conveyance passage V as described above, or the cut sheet P may be conveyed along the route which passes through the conveyance passage V in a similar manner as the rolled sheet Rp.

The rolled sheet Rp or the cut sheet P, which is fed as described above, is conveyed to the sheet discharge tray 2 in accordance with the rotation of the roller pairs 34 to 36 by the driving of the conveyance motor 3M3.

The guide 37 is disposed between the roller pair 34 and the roller pair 35 in the conveyance direction. The guide 37 has a pair of members configured to sandwich the conveyance passage for the rolled sheet Rp or the cut sheet P.

The cutting part 4 is positioned downstream of the sheet feed tray 1 in the conveyance direction, and the cutting part 4 is positioned upstream of the roller pair 34 in the conveyance direction. The cutting part 4 includes a fixed blade 4*a* which extends in the left-right direction and a disc-shaped rotary blade 4*b* which is disposed at a position at which the rotary blade 4*b* contacts with the fixed blade 4*a*. The rotary blade 4*b* is moved in the left-right direction in accordance with the driving of the cutting motor 4M (see FIG. 5). With this, the rolled sheet Rp is cut in the left-right direction.

The head 5 corresponds to the "recording part" of the present disclosure. The head 5 is disposed between the roller pair 35 and the roller pair 36 in the conveyance direction. The head 5 has a plurality of nozzles which are open in a lower surface of the head 5, and a driver IC 5D (see FIG. 5). The head 5 may be based on any one of a line system in which ink is ejected from the nozzles in a state where a position of the head 5 is fixed and a serial system in which the ink is ejected from the nozzles while the head 5 is moved in the left-right direction. In a case where the rolled sheet Rp or the cut sheet P, which is conveyed by the conveyor 3, passes below the head 5, the ink is ejected from the nozzles in accordance with driving of the driver IC 5D. With this, an image is recorded on the rolled sheet Rp or the cut sheet P.

As depicted in FIG. 5, the controller 9 includes a CPU 91, a ROM 92, and a RAM 93. A program and/or data, which are (is) used by the CPU 91 so as to perform various controls, are (is) stored in the ROM 92. The RAM 93 temporarily stores data to be used in a case where the CPU 91 executes the program.

Rolled Sheet Sensor

As depicted in FIG. 1 and FIG. 2, the printer 100 further includes a rolled sheet sensor 6. The rolled sheet sensor 6 detects the rolled sheet Rp which is positioned downstream of the nipping point N in the conveyance direction. The rolled sheet sensor 6 corresponds to the "detector" of the present disclosure.

The rolled sheet sensor 6 is supported by a bottom wall of the casing 100*a*. The rolled sheet sensor 6 is configured to rotate about a shaft 6*x* extending in the left-right direction. The rolled sheet sensor 6 is urged in a counterclockwise direction as viewed in FIG. 1 and FIG. 2 by a spring or the like. The rolled sheet sensor 6 can take a non-detection position indicated by broken line in FIG. 1 and solid line in FIG. 2 and a detection position indicated by solid line in FIG. 1.

In a case where the rolled sheet sensor 6 is located at the non-detection position (see the broken line in FIG. 1), the rolled sheet sensor 6 closes the conveyance passage for the rolled sheet Rp. The rolled sheet Rp, which is unwound from the roll body R, passes through the nipping point N, and the rolled sheet Rp is brought in contact with the rolled sheet sensor 6. In this situation, the rolled sheet sensor 6, which is positioned at the non-detection position, is rotated clockwise as viewed in FIG. 1 about the shaft 6*x* against the urging force of the spring or the like, and the rolled sheet sensor 6 is moved to the detection position (see the solid line in FIG. 1). The rolled sheet sensor 6 contacts with the lower surface of the rolled sheet Rp at the detection position.

As depicted in FIG. 5, the rolled sheet sensor 6 is electrically connected to the controller 9. The rolled sheet sensor 6 sends an ON signal to the controller 9 at the detection position.

Pressing Mechanism

As depicted in FIG. 3, the printer 100 further includes a pressing mechanism 7.

The pressing mechanism 7 is moved to a pressing position (see FIG. 3B) at which the upper roller 31 and the lower roller 32 constructing the roller pair 30 are pressed against each other and a release position (see FIG. 3A) at which the upper roller 31 and the lower roller 32 are released from being pressed against each other. Note that, in a state where the pressing mechanism 7 is moved to the released position, the upper roller 31 and the lower roller 32 may be in contact or separated as long as the upper roller 31 and the lower roller 32 are released from being pressed against each other, because the rolled sheet Rp can be easily passed between the upper roller 31 and the lower roller 32.

Two roller pairs 30 are disposed while being separated from each other in the left-right direction. Two upper rollers 31 of the two roller pairs 30 are supported by an identical shaft 31*x*. A holder 74 is attached to each of a left end part and a right end part of the shaft 31*x*. The pair of holders 74 are supported by the bottom wall 1*a* of the sheet feed tray 1 via springs 74*s*. The pair of holders 74 and the two upper rollers 31 are supported by the shaft 31*x*, and the pair of holders 74 and the two upper rollers 31 are urged upward by the springs 74*s*.

The pressing mechanism 7 includes a cam gear 71, a push pin 72, a pair of pressing members 73, a coupling member 73*x* which couples the pair of pressing members 73, and a spring 73*s*. The cam gear 71 is rotated in accordance with driving of a pressing motor 7M (see FIG. 5). The push pin 72 is coupled to the cam gear 71. The push pin 72 is moved in the left-right direction in accordance with the rotation of the cam gear 71. The pair of pressing members 73 are disposed while being separated from each other in the left-right direction. The coupling member 73*x* extends in the left-right direction. The spring 73*s* connects the casing 100*a* and a left pressing member 73 of the pair of pressing members 73. The pair of pressing members 73 are urged rightward by the spring 73*s*.

The respective components described above, which construct the pressing mechanism 7, are supported by the casing 100*a*.

In a case where the pressing mechanism 7 is located at the release position (see FIG. 3A), the push pin 72 does not contact with the pressing member 73, and the pressing member 73 does not contact with the holder 74. In this situation, the two upper rollers 31 are urged upward by the springs 74*s*, and the two upper rollers 31 are separated, respectively, from two lower rollers 32.

Figure 3A:
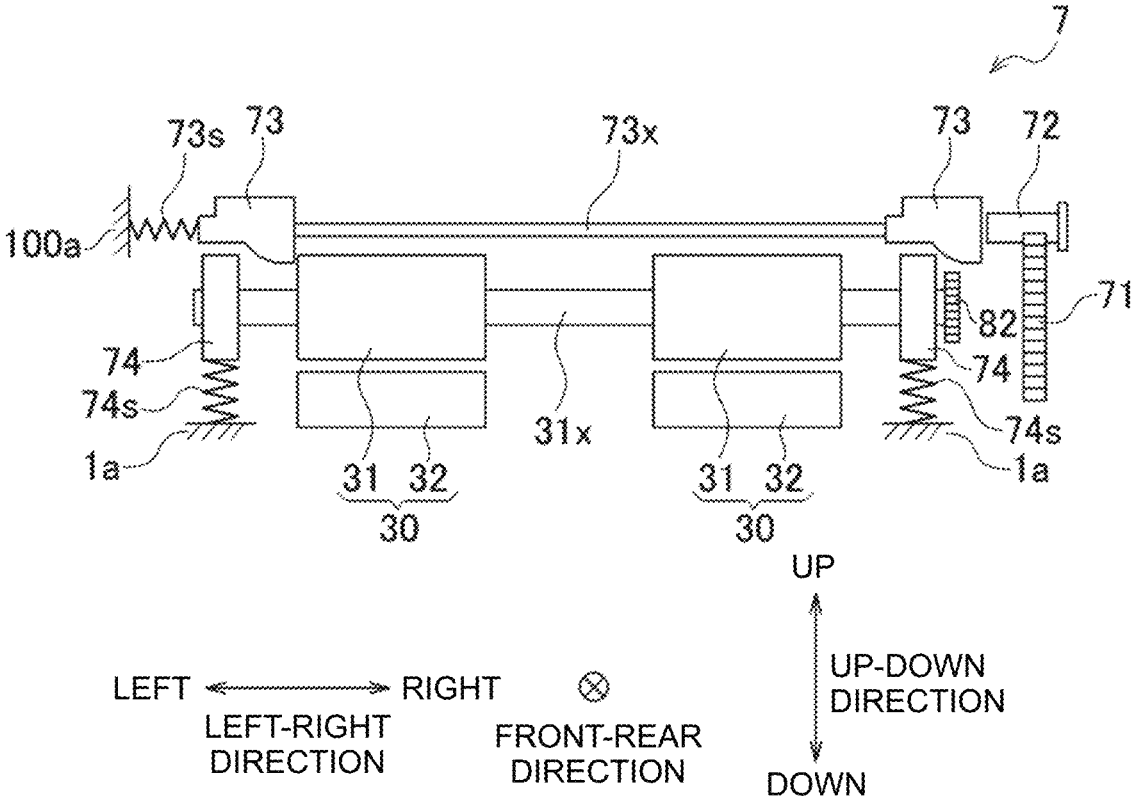
FIG. 3A is a schematic view depicting a state where two rollers depicted in FIG. 1 are separated from each other.
Figure 3B:
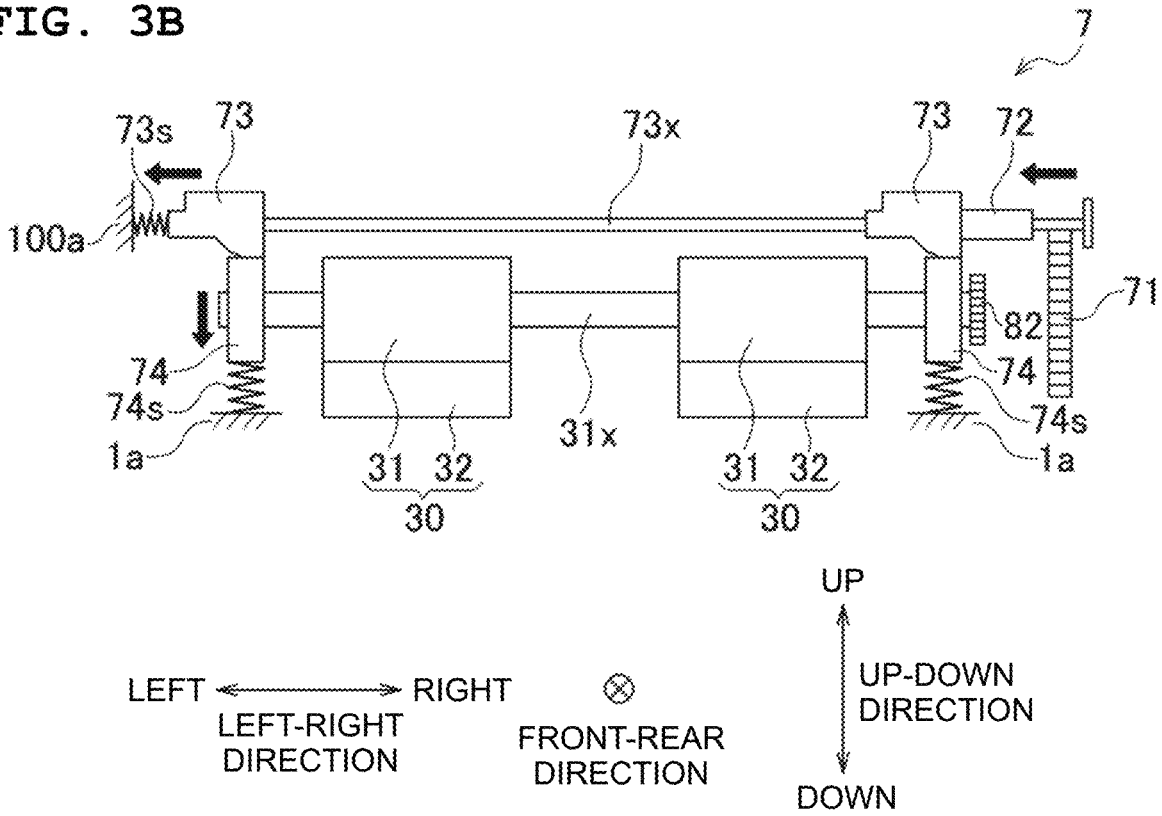
FIG. 3B is a schematic view depicting a state where the two rollers depicted in FIG. 1 contact with each other.

In a case where the pressing mechanism 7 is located at the release position (see FIG. 3A) and where the cam gear 71 is rotated in accordance with the driving of the pressing motor 7M (see FIG. 5), the push pin 72 is moved leftward (see FIG. 3B). The push pin 72 is moved leftward while pressing the right end of a right pressing member of the pair of pressing members 73. Accordingly, the pair of pressing members 73 are moved leftward against the urging force of the spring 73*s*. In this situation, the pair of pressing members 73 contact with the pair of holders 74, respectively, so as to press the pair of holders 74 downward. Accordingly, the two upper rollers 31 are moved downward together with the pair of holders 74 against the urging force of the springs 74*s*, and the two upper rollers 31 are brought in contact with the two lower rollers 32, respectively. In a case where the pressing mechanism 7 is located at the pressing position (see FIG. 3B), the upper roller 31 and the lower roller 32 of each of the two roller pairs 30 are pressed against each other. The rolled sheet Rp or the cut sheet P can be conveyed while being nipped between the upper roller 31 and the lower roller 32 of each of the two roller pairs 30.

Driving Mechanism of Roller Pairs 30

As described above, the two roller pairs 30 include the two upper rollers 31 which are rotated in accordance with the driving of the rotary motor 3M1 (see FIG. 5) and the two lower rollers 32 which are rotated in accordance with the rotation of the two upper rollers 31. A first gear 81 coupled to the rotary motor 3M1 and a second gear 82 coupled to the two upper rollers 31 are coupled to each other (see FIG. 4B), thereby applying the driving force of the rotary motor 3M1 to the two upper rollers 31.

The first gear 81 is supported by the casing 100*a*. The second gear 82 is supported by the sheet feed tray 1. Specifically, as depicted in FIGS. 3A and 3B, the second gear 82 is attached to a right end of the shaft 31*x*.

Figure 4A:
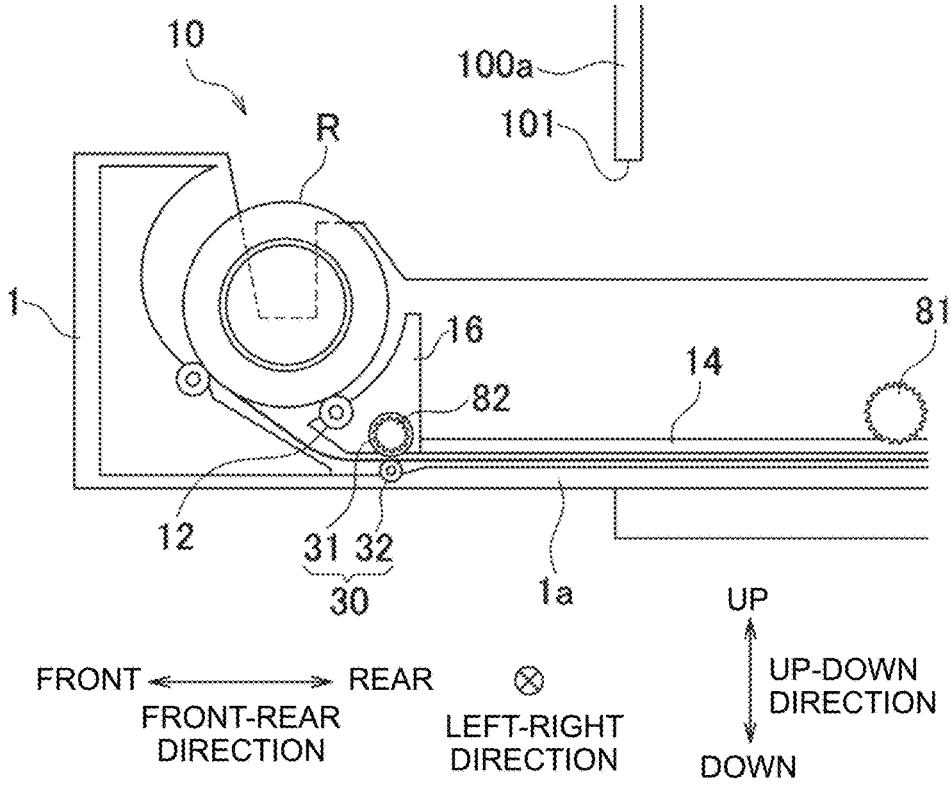
FIG. 4A is a side view depicting a state where the sheet feed tray is located at a withdrawn position in the printer depicted in FIG. 1.
Figure 4B:
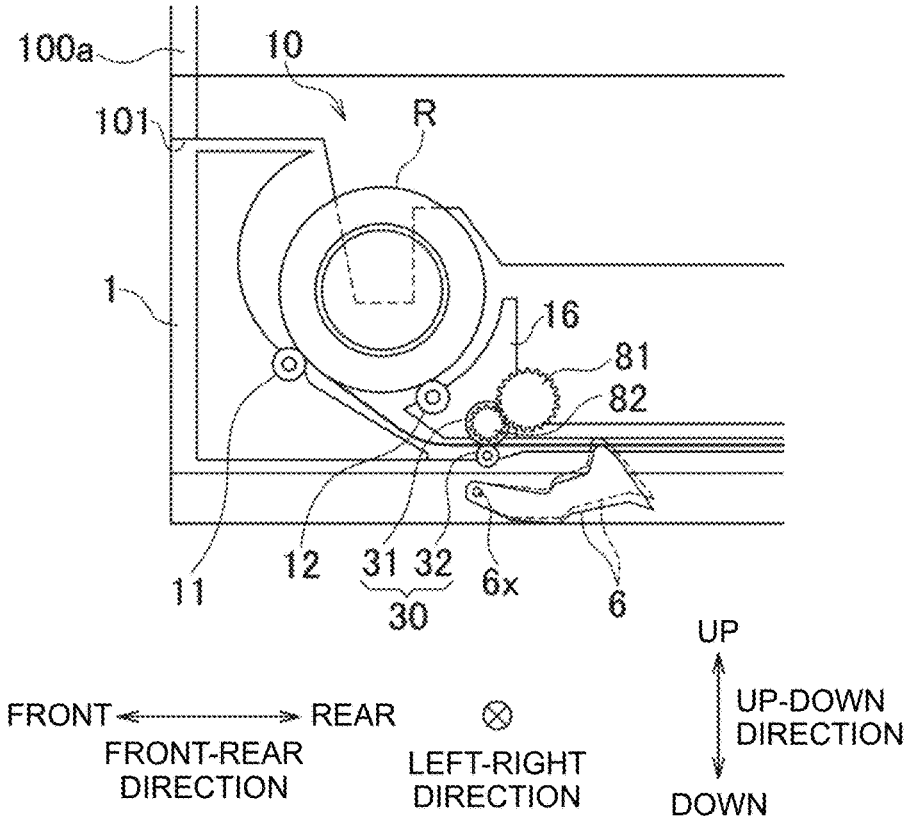
FIG. 4B is a side view depicting a state where the sheet feed tray is located at an attached position in the printer depicted in FIG. 1.

As depicted in FIG. 4A, in a case where the sheet feed tray 1 is located at the withdrawn position, the first gear 81 and the second gear 82 are not coupled to each other, and the driving force of the rotary motor 3M1 is not applied to the two upper rollers 31. Further, in this situation, the two roller pairs 30 are located outside the casing 100*a*, and the two upper rollers 31 and the two lower rollers 32 are separated from each other. In this state, the roll body R is accommodated in the first accommodating part 10. The rolled sheet Rp, which is unwound from the roll body R, passes through the space between the two upper rollers 31 and the two lower rollers 32. The rolled sheet Rp is nipped by the two upper rollers 31 and the two lower rollers 32.

The rolled sheet Rp can be nipped by the two roller pairs 30 in any one of the case in which the two upper rollers 31 and the two lower rollers 32 contact with each other and the case in which the two upper rollers 31 and the two lower rollers 32 are separated from each other.

In a case where the sheet feed tray 1 is moved from the withdrawn position (see FIG. 4A) to the attached position (see FIG. 4B), the first gear 81 and the second gear 82 are coupled to each other. That is, the first gear 81 and the second gear 82 are coupled to each other in cooperation with the movement of the sheet feed tray 1 from the withdrawn position to the attached position. In a case where the sheet feed tray 1 is located at the attached position, the first gear 81 and the second gear 82 are coupled to each other, thereby applying the driving force of the rotary motor 3M1 to the two upper rollers 31.

Content of Control

Figure 6:
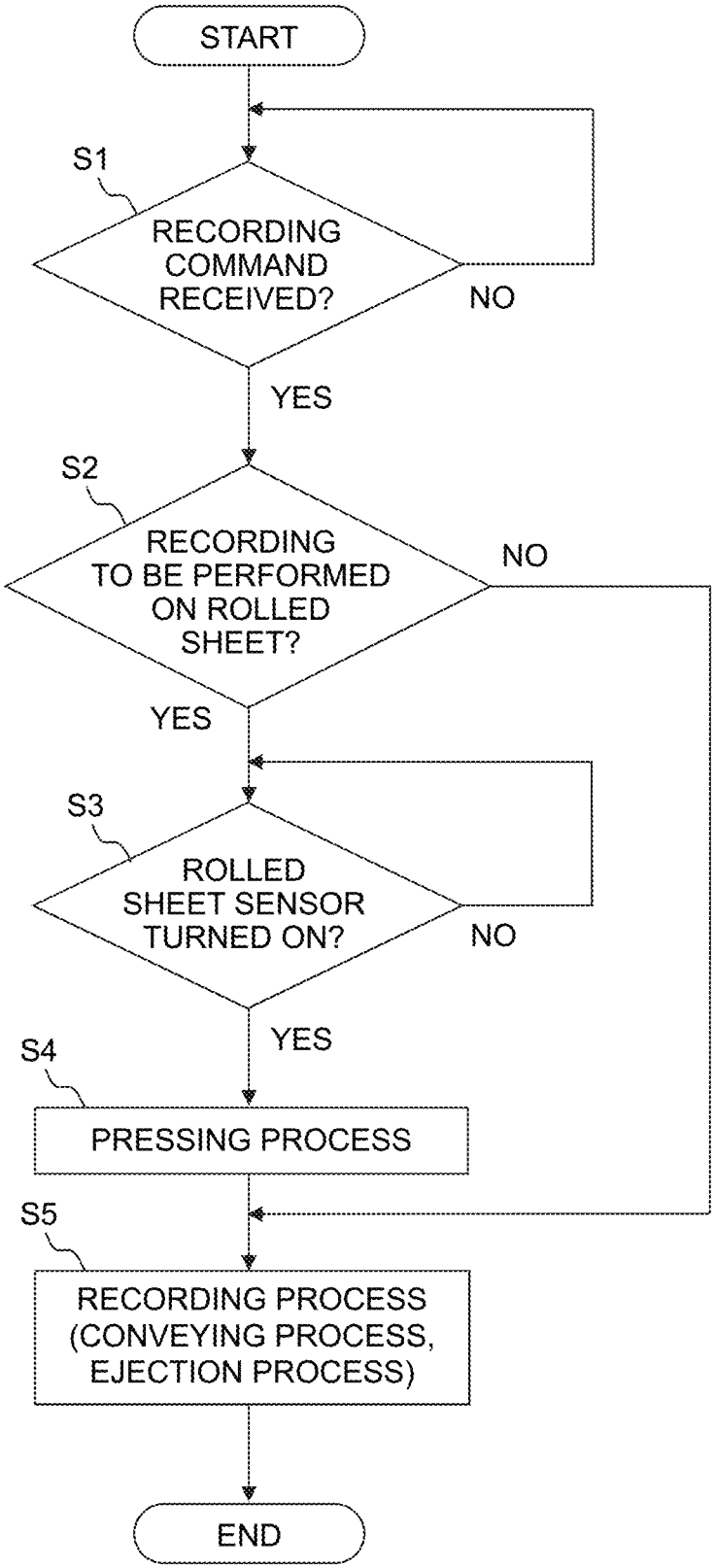
FIG. 6 is a flow chart indicating contents of control executed by a controller of the printer depicted in FIG. 1.

A program, which is executed by the controller 9 (CPU 91), will be described with reference to FIG. 6. Note that at a point of time at which the program is started, the sheet feed tray 1 is located at the attached position (see FIG. 1, FIG. 2, and FIG. 4B), and the pressing mechanism 7 is located at the release position (see FIG. 3A).

At first, the CPU 91 determines whether a recording command is received from an external apparatus such as PC or the like (S1: second determining process).

In a case where the CPU 91 determines that the recording command is not received (S1: NO), the CPU 91 repeats the process of S1.

In a case where the CPU 91 determines that the recording command is received (S1: YES), the CPU 91 determines whether the recording command instructs the CPU 91 to perform the recording on the rolled sheet Rp (S2).

In a case where the CPU 91 determines that the recording command instructs the CPU 91 to perform the recording on the rolled sheet Rp (S2: YES), the CPU 91 determines whether the rolled sheet sensor 6 transmits the ON signal (i.e., whether the rolled sheet Rp is detected by the rolled sheet sensor 6) (S3: first determining process).

In a case where the CPU 91 determines that the rolled sheet sensor 6 does not transmit the ON signal (S3: NO), the CPU 91 repeats the process of S3.

In a case where the CPU 91 determines that the rolled sheet sensor 6 transmits the ON signal (S3: NO), the CPU 91 drives the pressing motor 7M (see FIG. 5) so as to move the pressing mechanism 7 from the release position (see FIG. 3A) to the pressing position (see FIG. 3B) (S4: pressing process).

After S4, or in a case where the CPU 91 determines that the recording command does not instruct the CPU 91 to perform the recording on the rolled sheet Rp (i.e., the recording command instructs the CPU 91 to perform the recording on the cut sheet P) (S2: NO), the CPU 91 executes the recording process (S5).

In a case where the recording command instructs the CPU 91 to perform the recording on the rolled sheet Rp, the CPU 91 drives the rotary motor 3M1, the sheet feed motor 3M2, and the conveyance motor 3M3 in the recording process (S5) so as to rotate the two roller pairs 30, the sheet feed roller 33, and the roller pairs 34 to 36. With this, a conveying process, in which the rolled sheet Rp is conveyed by the conveyor 3, is executed. Further, the CPU 91 drives the driver IC 5D so as to execute an ejection process in which the ink is ejected from the nozzles of the head 5.

In a case where the recording command does not instruct the CPU 91 to perform the recording on the rolled sheet Rp (i.e., the recording command instructs the CPU 91 to perform the recording on the cut sheet P), the CPU 91 drives the sheet feed motor 3M2 and the conveyance motor 3M3 so as to rotate the sheet feed roller 33 and the roller pairs 34 to 36, in the recording process (S5). With this, the conveying process, in which the cut sheet P is conveyed by the conveyor 3, is executed. Further, the CPU 91 drives the driver IC 5D so as to execute the ejection process in which the ink is ejected from the nozzles of the head 5.

After S5, the CPU 91 ends the program.

Effect

As described above, according to the embodiment of the present disclosure, the controller 9 executes the first determining process (S3) of determining whether the rolled sheet Rp is detected by the rolled sheet sensor 6. In a case where the controller 9 determines that the rolled sheet Rp is detected in the first determining process (S3: YES), the controller 9 executes the pressing process (S4) of moving the pressing mechanism 7 from the release position (see FIG. 3A) to the pressing position (see FIG. 3B). After the pressing process (S4), the controller 9 rotates the two roller pairs 30 so as to execute the conveying process (S5) for conveying the rolled sheet Rp by the conveyor 3. In this case, the two roller pairs 30 are rotated to start the conveyance in the state where the rolled sheet Rp is reliably nipped by the two roller pairs 30. Accordingly, the rolled sheet Rp can be appropriately conveyed.

The two roller pairs 30 are supported by the sheet feed tray 1. In a case where the sheet feed tray 1 is located at the withdrawn position, the two roller pairs 30 are located outside the casing 100*a* (see FIG. 4A). A user can accommodate the roll body R in the first accommodating part 10 while causing the sheet feed tray 1 to be located at the withdrawn position. The user can cause the two roller pairs 30 to nip the rolled sheet Rp unwound from the roll body R, and the user can set the sheet feed tray 1 at the attached position. Accordingly, the rolled sheet Rp can be reliably nipped by the two roller pairs 30.

In a case where the sheet feed tray 1 is located at the withdrawn position, the first gear 81 and the second gear 82 are not coupled to each other. In a case where the sheet feed tray 1 is located at the attached position, the first gear 81 and the second gear 82 are coupled to each other (see FIG. 4). In this case, the rotational force can be applied to the roller pairs 30 by setting the sheet feed tray 1 at the attached position.

The rear wall of the sheet feed tray 1 (the wall constructing the downstream end in the conveyance direction of the sheet feed tray 1) has the first wall part 1*x* and the second wall part 1*y* which is separated frontward from the first wall part 1*x* (see FIG. 1). The space between the first wall part 1*x* and the second wall part 1*y* constructs the conveyance passage V through which the rolled sheet Rp is conveyed from the roller pairs 30 toward the cutting part 4. For example, in a case where the rolled sheet Rp is jammed, the user cuts the rolled sheet Rp by the cutting part 4, and then the user moves the sheet feed tray 1 from the attached position to the withdrawn position. After that, the user removes a damaged part of the rolled sheet Rp by a cutter or the like, at the outside of the printer 100. After that, the user sets the roll body R in the sheet feed tray 1, and the user causes the rolled sheet Rp, which is unwound from the roll body R, to pass through the space between the first wall part 1*x* and the second wall part 1*y*, and the user moves the sheet feed tray 1 from the withdrawn position to the attached position. With this, the rolled sheet Rp is smoothly guided to the cutting part 4 in the conveying process to be performed thereafter, thus preventing the jam from occurring again.

The controller 9 executes the pressing process (S4) in a case where the controller 9 determines that the rolled sheet Rp is detected in the first determining process (S3: YES) and the controller 9 determines that the recording command is received in the second determining process (S1: YES). In other words, even in a case where the rolled sheet Rp is detected, the upper rollers 31 and the lower rollers 32 constructing the two roller pairs 30 are maintained to be separated from each other (see FIG. 3A) during the period of time in which the recording command is not received. With this, a load, which is exerted on the two roller pairs 30 by the contact between the upper rollers 31 and the lower rollers 32, can be mitigated.

The sheet feed tray 1 has not only the first accommodating part 10 which can accommodate the roll body R but also the second accommodating part 20 which can accommodate the plurality of cut sheets P in the stacked state (see FIG. 2). The conveyor 3 has the sheet feed roller 33 and the torsion spring 33*s* as a feeding mechanism of the cut sheet P. In a case where the cut sheets P are to be fed by a roller pair, it is difficult to convey the cut sheets P continuously. In the embodiment of the present disclosure, the sheet feed roller 33 and the torsion spring 33*s* rather than the roller pair are adopted as the feeding mechanism of the cut sheets P. Therefore, the cut sheets P can be continuously conveyed.

Modifications

The embodiment of the present disclosure has been described above. However, the present disclosure is not limited to the embodiment described above, and various design change are possible within the scope defined in the claims.

In the embodiment described above, the first accommodating part and the second accommodating part are aligned in the front-rear direction. However, the present disclosure is not limited to this. For example, the first accommodating part and the second accommodating part may be aligned in the up-down direction. In this case, a tray having the first accommodating part and a tray having the second accommodating part may be disposed, respectively, at upper and lower positions in the casing.

In the embodiment described above, the first accommodating part and the second accommodating part are included in the tray which is movable with respect to the casing. However, the present disclosure is not limited to this. For example, a space in the casing may construct the first accommodating part and the second accommodating part.

In the embodiment described above (see FIG. 1 and FIG. 2), the sheet feed roller 33 (feed roller) is supported at the forward end of the arm 33, and the sheet feed roller 33 is urged by the torsion spring 33*s* (urging part) in the direction in which the sheet feed roller 33 is brought in contact with the cut sheet P. However, the present disclosure is not limited to this. For example, the sheet feed roller 33 may be located at a constant position, and the support plate 14, which supports the cut sheet(s) P, may be movable in the up-down direction depending on a remaining amount of the cut sheet(s) P. In other words, the support plate 14 may be urged upward by an urging part (spring or the like) so that the cut sheet P is brought in contact with the sheet feed roller 33.

The pressing mechanism is not limited to the configuration of the embodiment described above (see the pressing mechanism 7 depicted in FIGS. 3A and 3B). For example, the pressing mechanism may be configured such that one of the two roller pairs is moved in a direction of the rotation axis of the roller pair (left-right direction in FIG. 1) by using a belt or the like.

In the embodiment described above, the two roller pairs are supported by the sheet feed tray 1 (tray). However, the two roller pairs may be supported by the casing. In such a configuration, in a case where the tray is moved from the withdrawn position to the attached position, the sheet medium may pass through the space between the two roller pairs, and the sheet medium may be nipped at the nipping point by the two roller pairs.

In the embodiment described above (see FIG. 4), the first gear and the second gear are coupled to each other in cooperation with the movement of the tray from the withdrawn position to the attached position. However, the first gear and the second gear may be coupled to each other in accordance with the control of the controller.

The sheet medium is not limited to paper sheet. The sheet medium may be, for example, cloth or resin member.

The recording part is not limited to the recording part based on the liquid ejection system. The recording part may be based on, for example, the laser system or the thermal transfer system.

The second accommodating part may be omitted in the conveying apparatus according to the present disclosure.

In the embodiment described above, the printer 100 has the two roller pairs 30. However, the number of the roller pair 30 may be one, or three or more.

The conveying apparatus according to the present disclosure can be applied not only to the printer but also to a facsimile, a copying machine, or the like. Further, the recording part may be omitted in the conveying apparatus according to the present disclosure.

What is claimed is:

1. A conveying apparatus comprising:

a conveyor configured to convey a first sheet medium unwound from a roll body in a conveyance direction, the conveyor including a first roller and a second roller configured to nip the first sheet medium at a nipping point;

a pressing mechanism configured to be moved to a pressing position at which the first roller and the second roller are pressed against each other and a release position at which the first roller and the second roller are released from being pressed against each other;

a detector configured to detect the first sheet medium located downstream of the nipping point in the conveyance direction; and a controller, wherein the controller is configured to execute:

a first determining process of determining whether the first sheet medium is detected by the detector;

a pressing process of moving the pressing mechanism from the release position to the pressing position in a case where the controller determines that the first sheet medium is detected in the first determining process; and a conveying process of causing the conveyor to convey the first sheet medium by rotating the first roller and the second roller after the pressing process.

2. The conveying apparatus according to claim 1, further comprising:

a casing; and a tray configured to be moved to an attached position at which the tray is attached to the casing and a withdrawn position at which the tray is withdrawn from the attached position, the tray being configured to accommodate the roll body, wherein the first roller and the second roller are supported by the tray, and the first roller and the second roller are located outside the casing in a case where the tray is located at the withdrawn position.

3. The conveying apparatus according to claim 2, further comprising:

a first gear supported by the casing, the first gear being coupled to a motor configured to apply rotational force to the first roller and the second roller; and a second gear supported by the tray, the second gear being coupled to at least one of the first roller and the second roller, wherein the first gear and the second gear are not coupled to each other in a case where the tray is located at the withdrawn position, and the first gear and the second gear are coupled to each other in a case where the tray is located at the attached position.

4. The conveying apparatus according to claim 1, further comprising:

a casing;

a tray configured to be moved to an attached position at which the tray is attached to the casing and a withdrawn position at which the tray is withdrawn from the attached position, the tray being configured to accommodate the roll body; and a cutting part supported by the casing and configured to cut the first sheet medium at downstream of the tray in the conveyance direction, wherein a wall, which constructs a downstream end of the tray in the conveyance direction, has a first wall part and a second wall part separated from the first wall part, and a space defined between the first wall part and the second wall part constructs a conveyance passage along which the first sheet medium is conveyed from the first roller and the second roller to the cutting part.

5. The conveying apparatus according to claim 1, further comprising a recording part configured to record an image on the first sheet medium conveyed by the conveyor, wherein the controller is configured to further execute a second determining process of determining whether a recording command is received, and the controller is configured to execute the pressing process in a case where the controller determines that the first sheet medium is detected in the first determining process and the controller determines that the recording command is received in the second determining process.

6. The conveying apparatus according to claim 1, further comprising:

a first accommodating part configured to accommodate the roll body; and a second accommodating part configured to accommodate a plurality of second sheet media in a stacked state, wherein each of the second sheet media is shorter than the first sheet medium, and the conveyor further includes, a feed roller configured to feed, in the conveyance direction, an uppermost second sheet medium of the second sheet media accommodated in the second accommodating par, and an urging part configured to urge at least one of the feed roller and the second sheet media in a direction in which the feed roller contacts with the uppermost second sheet medium.

7. A control method for controlling a conveying apparatus, the conveying apparatus including: a conveyor configured to convey a sheet medium unwound from a roll body in a conveyance direction, the conveyor having a first roller and a second roller configured to nip the sheet medium at a nipping point; a pressing mechanism configured to be moved to a pressing position at which the first roller and the second roller are pressed against each other and a release position at which the first roller and the second roller are released from being pressed against each other; and a detector configured to detect the sheet medium located downstream of the nipping point in the conveyance direction, the control method comprising:

a first determining process of determining whether the sheet medium is detected by the detector;

a pressing process of moving the pressing mechanism from the release position to the pressing position in a case where a determination is made that the sheet medium is detected in the first determining process; and a conveying process of causing the conveyor to convey the sheet medium by rotating the first roller and the second roller after the pressing process.

8. A non-transitory medium storing a program for a conveying apparatus, the conveying apparatus including: a conveyor configured to convey a sheet medium unwound from a roll body in a conveyance direction, the conveyor having a first roller and a second roller configured to nip the sheet medium at a nipping point; a pressing mechanism configured to be moved to a pressing position at which the first roller and the second roller are pressed against each other and a release position at which the first roller and the second roller are released from being pressed against each other; and a detector configured to detect the sheet medium located downstream of the nipping point in the conveyance direction, the program causing the conveying apparatus to execute:

a first determining process of determining whether the sheet medium is detected by the detector;

a pressing process of moving the pressing mechanism from the release position to the pressing position in a case where a determination is made that the sheet medium is detected in the first determining process; and a conveying process of causing the conveyor to convey the sheet medium by rotating the first roller and the second roller after the pressing process.

* * * * *